US010322337B2

(12) United States Patent
Fan et al.

(10) Patent No.: US 10,322,337 B2
(45) Date of Patent: Jun. 18, 2019

(54) HEXAGONAL PRISMATIC PACKING PUZZLE

(71) Applicant: NATIONAL TSING HUA UNIVERSITY, Hsinchu (TW)

(72) Inventors: Ku-Yu Fan, New Taipei (TW); Wen-Liang Hung, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 0 days.

(21) Appl. No.: 15/981,358

(22) Filed: May 16, 2018

(65) Prior Publication Data

US 2018/0333639 A1 Nov. 22, 2018

(30) Foreign Application Priority Data

May 17, 2017 (TW) ..... 106207052 U

(51) Int. Cl.
*A63F 9/12* (2006.01)
*A63F 3/00* (2006.01)

(52) U.S. Cl.
CPC ..... *A63F 9/1208* (2013.01); *A63F 9/12* (2013.01); *A63F 2003/0082* (2013.01); *A63F 2009/1228* (2013.01); *A63F 2009/1236* (2013.01)

(58) Field of Classification Search
CPC ..... A63B 9/1208; A63F 2009/1228; A63F 2009/1236; A63F 9/1204; A63H 33/04; B65D 5/06; B65D 5/029; B65D 5/2033
See application file for complete search history.

(56) References Cited

U.S. PATENT DOCUMENTS 1,471,943 A * 10/1923 Chambers ..... A63F 9/12 273/157 R
2,342,623 A * 2/1944 Aquino ..... B65D 5/02 229/108
2,465,661 A * 3/1949 Ringler ..... B65D 5/06 229/110
2,644,633 A * 7/1953 Stopper ..... B65D 5/2038 229/110
2,659,525 A * 11/1953 Wikstrom ..... B65D 85/67 225/49
2,839,841 A * 6/1958 Berry ..... A63H 33/04 273/157 R
2,925,950 A * 2/1960 Burg ..... A45C 11/02 229/110
3,645,535 A * 2/1972 Randolph ..... A63F 9/12 273/157 R (Continued)

*Primary Examiner* — Steven B Wong
(74) *Attorney, Agent, or Firm* — Muncy, Geissler, Olds & Lowe, P.C.

(57) ABSTRACT

A hexagonal prismatic packing puzzle is provided, which includes 18 different shapes of puzzles. Each of the puzzles is composed of a plurality of unit components and the puzzles can be pieced together into a hexagonal prism. The unit components are selected from a group consisting of a first unit component and a second unit component. The volume of the first unit component is larger than that of the second unit component. The packing puzzle does not have an only solution or a specific solution. A user may develop and improve the sense of space and the cognitive of geometric figures thereof. Further, the user may train ability to think in multiple ways and achieve edutainment in the process of thinking.

10 Claims, 19 Drawing Sheets

(56) References Cited

U.S. PATENT DOCUMENTS

| | | | | | |
|---|---|---|---|---|---|
| 4,177,917 | A * | 12/1979 | Webinger | B65D 5/2033 | 229/110 |
| 4,258,479 | A * | 3/1981 | Roane | A63H 33/046 | 434/211 |
| 4,323,154 | A * | 4/1982 | Brandenfels | A63F 9/1044 | 206/216 |
| 4,334,870 | A * | 6/1982 | Roane | A63H 33/046 | 434/211 |
| 4,334,871 | A * | 6/1982 | Roane | A63H 33/046 | 434/211 |
| 4,573,683 | A * | 3/1986 | Lamle | A63F 9/12 | 273/157 R |
| 5,660,387 | A * | 8/1997 | Stokes | A63F 9/12 | 273/157 R |
| 6,257,574 | B1 * | 7/2001 | Evans | A63F 9/12 | 273/157 R |
| 8,061,713 | B2 * | 11/2011 | Cook | A63F 9/1204 | 273/157 R |
| 2008/0128478 | A1 * | 6/2008 | Quadrelli | B65D 5/029 | 229/110 |
| 2017/0072331 | A1 * | 3/2017 | Yang | A63H 33/06 | |
| 2018/0185745 | A1 * | 7/2018 | Gantumur | A63F 9/1288 | |

* cited by examiner

HEXAGONAL PRISMATIC PACKING PUZZLE

CROSS REFERENCE TO RELATED APPLICATION

This application claims priority from Taiwan Patent Application No. 10607052, filed on May 17, 2017 at Taiwan Intellectual Property Office, the contents of which are hereby incorporated by reference in their entirety for all purposes.

BACKGROUND OF THE INVENTION

1. Field of the Invention

The present creation is related to a packing puzzle. This piece of work in particular is a packing puzzle which has various shapes. In addition, the small pieces of the puzzle can be assembled into a hexagonal prism by different configurations and may be fitted into a puzzle frame or a slightly deformed frame structure.

2. Description of the Related Art

A puzzle game is a game which played by arranging or putting puzzle pieces or puzzle blocks with specific shapes into a specific frame, fills up the frame or forms a specific appearance. The puzzle game may improve the cognitive recognition of images, build up the sense of space, and train logical thinking, focus, and patience of a user. When the users are a school age children, the puzzle game may further induce their thinking abilities and improve their mathematical ability.

In prior puzzle games, most of them correspond to a single frame or a single solution, such as Tan-gram, Bermuda Triangle and round blocks. The difficulty is usually determined by the number of pieces in the puzzles. In terms of the puzzle pieces, most of the puzzle games are composed of the same unit components such as rectangular, triangular, cylindrical and spherical unit components. However, even though a puzzle game has not only one solution, the final structures and the solution varieties of the prior puzzle games are limited because of the limitation of their design. Similarly, the improvement of the thinking training is also limited.

Hence, the present creation designs a hexagonal prismatic packing puzzle to solve the aforementioned problems, improve the defects of the prior techniques and enhance industry implementations of the related creations.

SUMMARY OF THE INVENTION

In view of the aforementioned problems of the prior arts, the object of the present creation is providing a hexagonal prismatic packing puzzle to improve the lack of variety of the structure of puzzle games and the corresponding solutions.

According to the present invention, a hexagonal prismatic packing puzzle is provided, which comprises: a plurality of puzzles which are able to be pieced into a hexagonal prism, wherein each of the plurality of puzzles is an integrated puzzle or a puzzle being able to be disassembled composed of a plurality of unit components, the shapes of the plurality of the unit components are selected from a group consisting of a first unit component and a second unit component, the first unit component and the second unit component are formed by division along a section formed by three vertices of a triangular prism, the first unit component has a volume larger than that of the second unit component, and the height of the triangular prism is equal to half of the side length of the triangular prism.

Preferably, the plurality of the puzzles comprises 18 different shapes, and the number of the plurality of puzzles is 21.

Preferably, the plurality of the puzzles comprising 18 different shapes comprises: a first puzzle composed of two pieces of the second unit components; a second puzzle composed of two pieces of the first unit components; a third puzzle composed of one piece of the first unit component and one piece of second unit component; a fourth puzzle composed of one piece of the first unit component and one piece of the second unit component, wherein a configuration of the plurality of unit components of the fourth puzzle is different from a configuration of the third puzzle; a fifth puzzle composed of one piece of the first unit component and one piece of the second unit component, wherein a configuration of the plurality of unit components of the fifth puzzle is different from that of the third puzzle and the fourth puzzle; a sixth puzzle composed of one piece of the first unit component and one piece of the second unit component, wherein a configuration of the plurality of unit components of the sixth puzzle is different from that of the third puzzle, the fourth puzzle and the fifth puzzle; a seventh puzzle composed of one piece of the first unit component and two pieces of the second unit components; a eighth puzzle composed of two pieces of the first unit components and one piece of the second unit component; a ninth puzzle composed of two pieces of the third puzzles; a tenth puzzle composed of two pieces of the third puzzles, wherein a configuration of the two pieces of the third puzzles of the tenth puzzle is different from the configuration that of the ninth puzzle; an eleventh puzzle composed of two pieces of the fourth puzzles; a twelfth puzzle composed of one piece of the fifth puzzle and one piece of the sixth puzzle; a thirteenth puzzle composed of two pieces of the fourth puzzles, wherein a configuration of the two pieces of the fourth puzzle of the thirteenth puzzle is different from that of the eleventh puzzle; a fourteenth puzzle composed of one piece of the first unit component, one piece of the second unit component and one piece of the third puzzle; a fifteenth puzzle composed of two pieces of the second unit component and one pieces of the third puzzle; a sixteenth puzzle composed of two pieces of the first unit components and one third puzzle; a seventeenth puzzle composed on two pieces of the second unit components and two piece of the third puzzles; and a eighteenth puzzle composed of two pieces of the first unit components and two pieces of the third puzzles.

Preferably, the numbers of the seventh puzzle, the eighth puzzle and the fourteenth puzzle are 2.

Preferably, the plurality of the puzzle comprises a plurality of arrangements for piecing together into a hexagonal prism.

Preferably, the hexagonal prismatic packing puzzle further comprises a puzzle frame, wherein: the puzzle frame comprises an upper cover, a lower cover and two side plates, the upper cover and the lower cover have a plurality of grooves individually, the two side plates insert into the plurality of grooves to form an accommodating space corresponding to the hexagonal prism.

Preferably, the plurality of the grooves is disposed with a slope angle; and a side slope angle of the hexagonal prismatic within the accommodating space is adjusted by the slope angle, wherein, the slope angle is 30°.

Preferably, a separation groove is disposed at the upper cover and the lower cover; and a separation plate is inserted into the separation groove to adjust a volume of the accommodating space, wherein, the volume of the accommodating space is equal to ⅔ of the volume of the hexagonal prism.

As described above, the hexagonal prismatic packing puzzle has one or more advantages described below:

(1) The hexagonal prismatic packing puzzle two unit components with different volume and shapes. In comparison with the prior puzzle games which only have a single type of puzzle, the present creation is much more complex and may be more effective in the improvement of logical thinking and sense of space.

(2) The hexagonal prismatic packing puzzle adapts to a puzzle frame having a hexagonal prismatic accommodating space, which provides the convenience when piecing the puzzles and makes it portable. Simultaneously, the adjustment of the frame plate may provide hexagonal prisms with various volumes and side angels. Thus, variety of the configurations may be enhanced.

(3) The hexagonal prismatic packing puzzle does not have a specific pattern, and is not limited to a single solution. Depending on various users, various puzzles may be designed by configuring the puzzle to various initial puzzles, in order to adjust the difficulties of the puzzle and make sure to adapt to the users of various ages.

DESCRIPTION OF THE PREFERRED EMBODIMENTS

Figure 1:
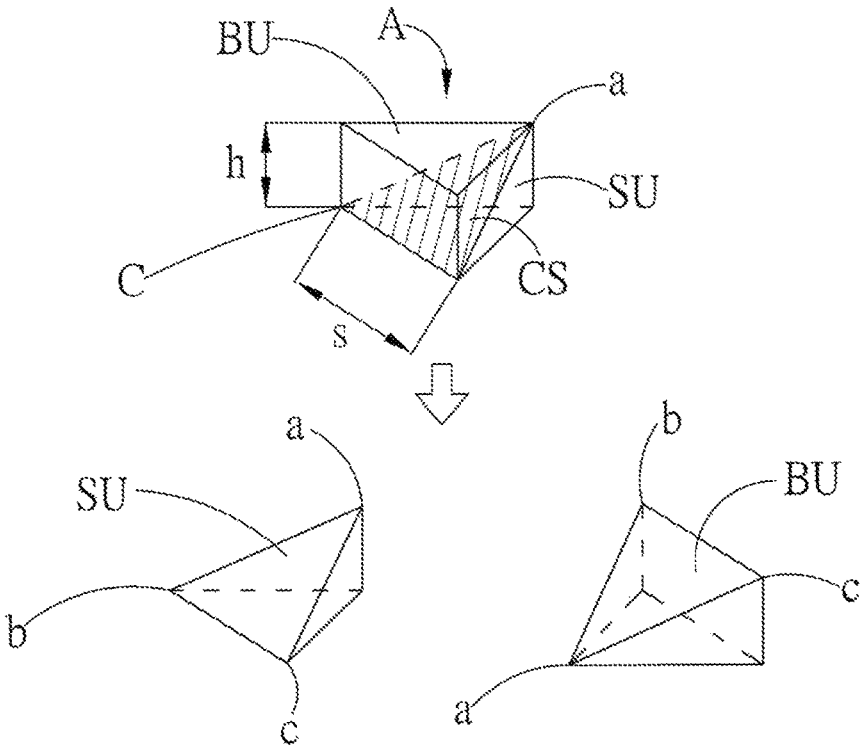
FIG. 1 is the schematic scheme of the unit component of the present creation.

For ease of explaining the technical features, contents and advantages of the present creation to the Examiner, the present creation will be described hereinafter by embodiment taken in conjunction with the appended drawings. The mentioned drawings are only for demonstrating and supporting this specification but are not exactly the real ratio and accurate configuration upon implementation. Hence, the creation shall not be realized only depending on the ratios and configurations shown in the drawings, and shall not be limited upon practice.

Please refer to FIG. 1, which is the schematic scheme of the unit element of the present creation. As shown in the figure, each of the puzzles of the hexagonal prismatic packing puzzle is composed of two or more unit components. Wherein, the unit component is selected form the group consisting of a first unit component and a second unit component which have different volumes. In the present embodiment, the first unit component may be a big unit component BU, and the second unit component may be a small unit component SU, but the present creation is not limited thereto. The big unit component BU is constructed together with the small unit component SU. In particular, the construction process is to dispose a triangular prism A of which the height h is equal to half of the side length s of the triangle. The triangular prism A is divided into two parts along the section CS formed by three vertices a, b and c, wherein the smaller part is the small unit component SU and the larger part is the big unit component BU.

In order to describe the small unit component SU and the big unit component BU more clearly to be beneficial in the description of puzzles. The shapes of big unit component BU and small unit component SU are described by coordinated vertices defined in a three-dimension coordinate system. For example, the coordinates of the four vertices of small unit component SU and the five vertices of big unit component BU are shown in Table 1.

TABLE 1

| Unit Component | Vertex Coordinate |
|---|---|
| Small Unit Component SU | $(0, 0, 0), (2, 2\sqrt{3}, 0), (-2, 2\sqrt{3}, 0), (0, 0, 2)$ |
| Big Unit Component BU | $(0, 0, 2), (2, 2\sqrt{3}, 0), (-2, 2\sqrt{3}, 0), (2, 2\sqrt{3}, 2), (-2, 2\sqrt{3}, 2)$ |

Hereinafter, the puzzles will be described with the same ratios as the unit components in Table 1. The values in the table are only for describing the shape of the unit components but not for limiting the substantial length of the puzzles.

Figure 2:
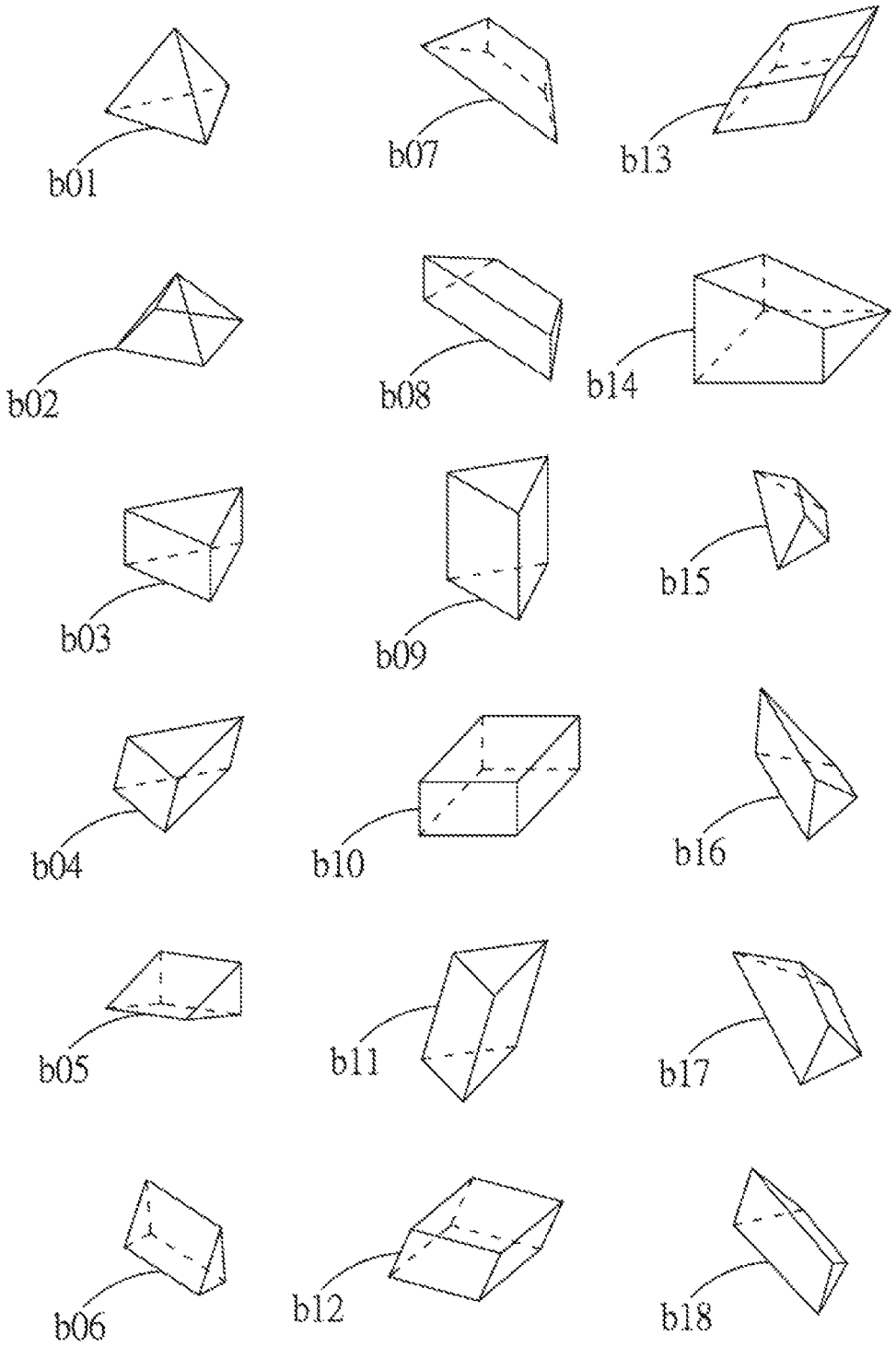
FIG. 2 is the schematic scheme of the puzzles having various shapes of the present creation.

Herein, various puzzles composed of the big unit components BU and small unit components SU will be described. Please refer to FIG. 2, which is a schematic scheme of the puzzles having various shapes of the present creation. As shown in the figure, in the present embodiment, the puzzles are classified into 18 shapes comprising the first puzzle b01 to the eighteenth puzzle b18. Each puzzle is a convex polyhedron composed of two or more unit components, and may be an integrated puzzle or a puzzle being able to be disassembled. Similarly, each of the puzzles is labeled according to the said three-dimension coordinate system. Corresponding to FIG. 2, the vertex coordinates of the 18 shapes of puzzles, that is, first puzzle b01 to the eighteenth puzzle b18 are shown in Table 2.

TABLE 2

| Unit Component | Vertex Coordinate |
|---|---|
| The First Puzzle b01 | $(2, 0, 0), (-2, 0, 0), (0, 4, 0), (0, 2, 2\sqrt{3})$ |
| The Second Puzzle b02 | $(2, 2, 0), (2, -2, 0), (-2, 2, 0), (-2, -2, 0), (0, 0, 2\sqrt{3})$ |

TABLE 2-continued

| Unit Component | Vertex Coordinate |
|---|---|
| The Third Puzzle b03 | (2, 0, 0), (−2, 0, 0), (0, 2√3, 0), (2, 0, 2), (−2, 0, 2), (0, 2√3, 2) |
| The Fourth Puzzle b04 | (2, 0, 0), (−2, 0, 0), (0, 4, 0), (2, 1, √3), (−2, 1, √3), (0, 5, √3) |
| The Fifth Puzzle b05 | (−4, 0, 0), (0, 0, 0), (2, 2√3, 0), (−2, 2√3, 0), (2, 2√3, 2), (−2, 2√3, 2) |
| The Sixth Puzzle b06 | (4, 0, 0), (0, 0, 0), (2, 2√3, 0), (−2, 2√3, 0), (2, 2√3, 2), (−2, 2√3, 2) |
| The Seventh Puzzle b07 | (4, 0, 0), (−4, 0, 0), (2, 2√3, 0), (−2, 2√3, 0), (2, 2√3, 2), (−2, 2√3, 2) |
| The Eighth Puzzle b08 | (4, 0, 0), (−4, 0, 0), (2, 2√3, 0), (−2, 2√3, 0), (4, 0, 2), (−4, 0, 2) |
| The Ninth Puzzle b09 | (2, 0, 0), (−2, 0, 0), (0, 2√3, 0), (2, 0, 4), (−2, 0, 4), (0, 2√3, 4) |
| The Tenth Puzzle b10 | (4, 0, 0), (0, 0, 0), (2, 2√3, 0), (−2, 2√3, 0), (4, 0, 2), (0, 0, 2), (2, 2√3, 2), (−2, 2√3, 2) |
| The Eleventh Puzzle b11 | (2, 0, 0), (−2, 0, 0), (4, 0, 0), (2, 2, 2√3), (−2, 2, 2√3), (0, 6, 2√3) |
| The Twelfth Puzzle b12 | (4, 0, 0), (0, 0, 0), (2, 2√3, 0), (−2, 2√3, 0), (4, 1, √3), (0, 1, √3), (2, 5, √3), (−2, 5, √3) |
| The Thirteenth Puzzle b13 | (0, 0, 0), (2, 4, 0), (−2, 4, 0), (0, 8, 0), (0, 1, √3), (2, 5, √3), (−2, 5, √3), (0, 9, √3) |
| The Fourteenth Puzzle b14 | (0, 0, 0), (4, 0, 0), (2, 2√3, 0), (−2, 2√3, 0), (0, 0, 2), (2, 2√3, 2), (−2, 2√3, 4) |
| The Fifteenth Puzzle b15 | (2, 4, 0), (−2, 0, 0), (0, 4, 0), (4, 0, 0), (0, 2, 2√3), (2, 2, 2√3) |
| The Sixteenth Puzzle b16 | (4, 4, 0), (−2, 0, 0), (−2, 4, 0), (4, 0, 0), (0, 2, 2√3), (2, 2, 2√3) |
| The Seventeenth Puzzle b17 | (2, 4, 0), (−4, 0, 0), (−2, 4, 0), (4, 0, 0), (−2, 2, 2√3), (2, 2, 2√3) |
| The Eighteenth Puzzle b18 | (4, 4, 0), (−4, 0, 0), (−4, 4, 0), (4, 0, 0), (−2, 2, 2√3), (2, 2, 2√3) |

In the aforementioned 18 shapes of the puzzles, the seventh puzzle b07, the eighth puzzle b08 and the fourteenth puzzle b14 may be composed of two repeated puzzles. Hence, the piece number of the puzzles of the present embodiment may be 21. A hexagonal prism may be pieced by these 21 shapes of puzzles, and a hexagonal prism having smaller size or different slope angles may also be pieced by picking up appropriate puzzles. The detail of the piecing configurations will be explained below taken in conjunction with a puzzle frame.

Figure 3:
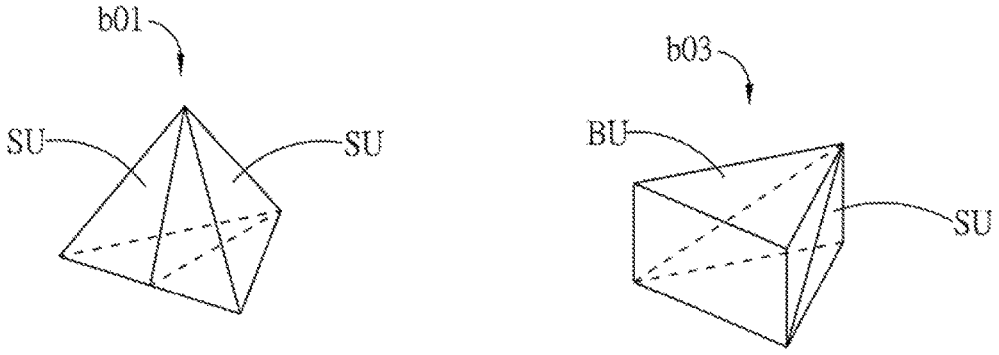
FIG. 3 is a schematic scheme of the combination of the first puzzle and the third puzzle.

Please refer to FIG. 3, which is the schematic scheme of the combination of the first puzzle and the third puzzle. As described above, the puzzles of the present creation have 18 different shapes, which are composed of two to six unit components (big unit component BU or small unit component SU). For instance, as shown in FIG. 3, the first puzzle b01 is composed of two small unit components SU and the third puzzle b03 is composed of one big unit component BU and one small unit component SU. The configurations of other puzzles of the present embodiment are listed in Table 3.

In Table 3, although the third puzzle b03 to the sixth puzzle b06 are composed of one big unit component BU and one small unit component SU, the configurations of the big unit component BU and the small unit component SU therein are different. Hence, the said four kinds of puzzle have different shapes, which can be referred to the drawings and the coordinate listed in Table 2. The same as above, the shapes are also different from each other between the ninth puzzle b09 and the tenth puzzle b10, and the eleventh puzzle b11 and the thirteenth puzzle b13. Further, the arrangement and configuration of the unit components thereof are also different, so that the shapes of these 18 kinds of puzzle are different.

Figure 4A:
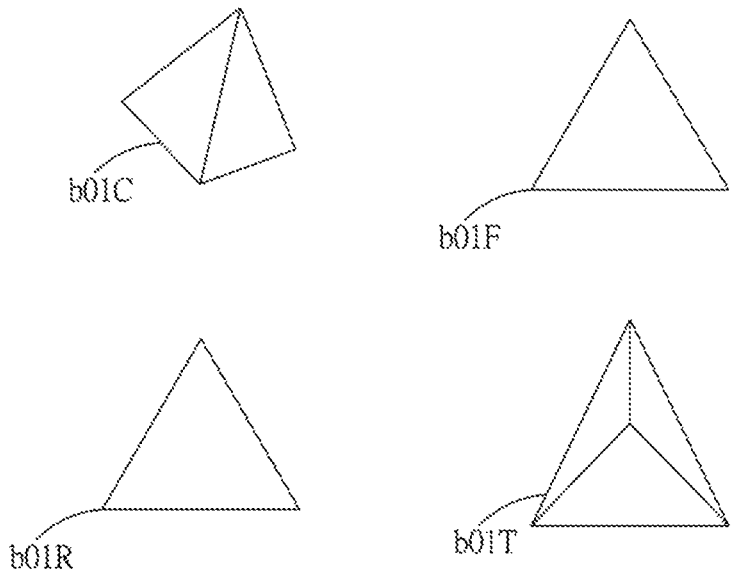
FIGS. 4A to 4R are each the stereo-gram and three-view drawing of the first puzzles to the eighteenth puzzles of the present creation.
Figure 4B:
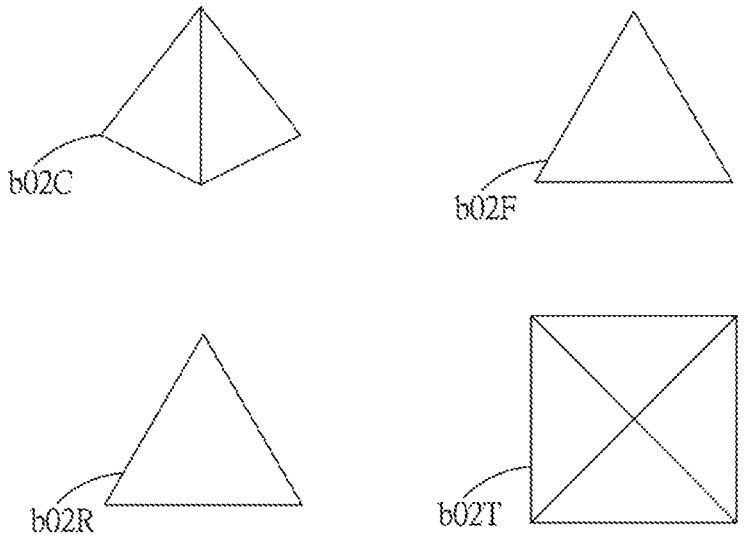
Figure 4C:
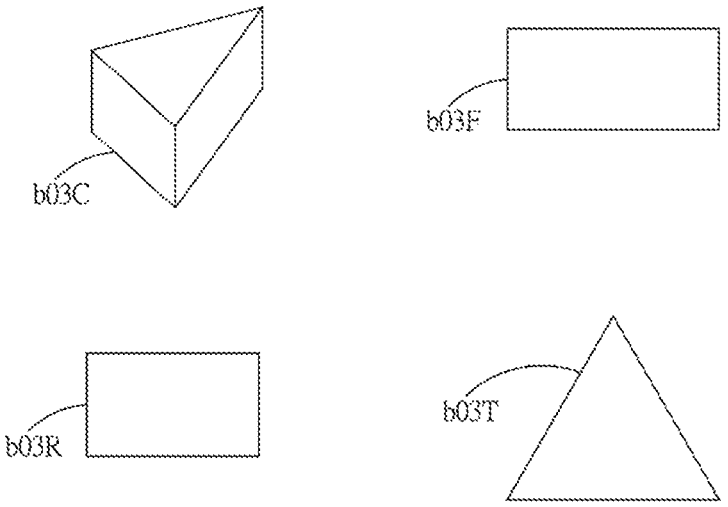
Figure 4D:
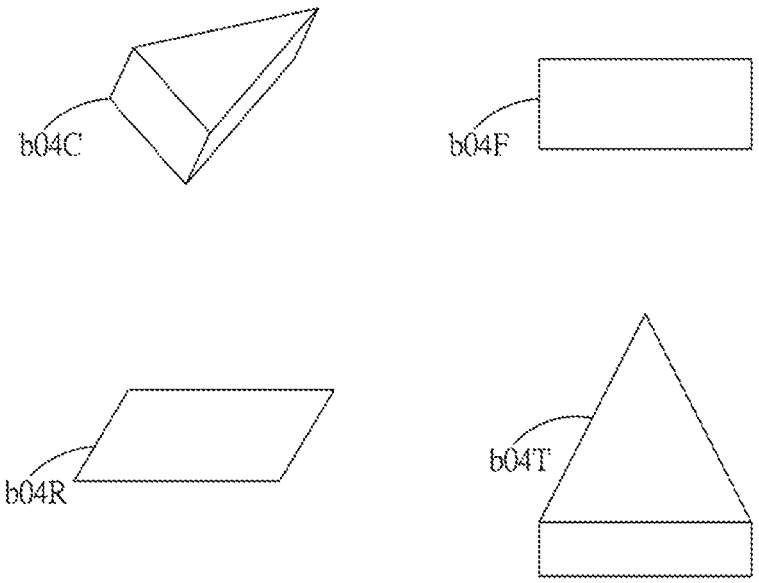
Figure 4E:
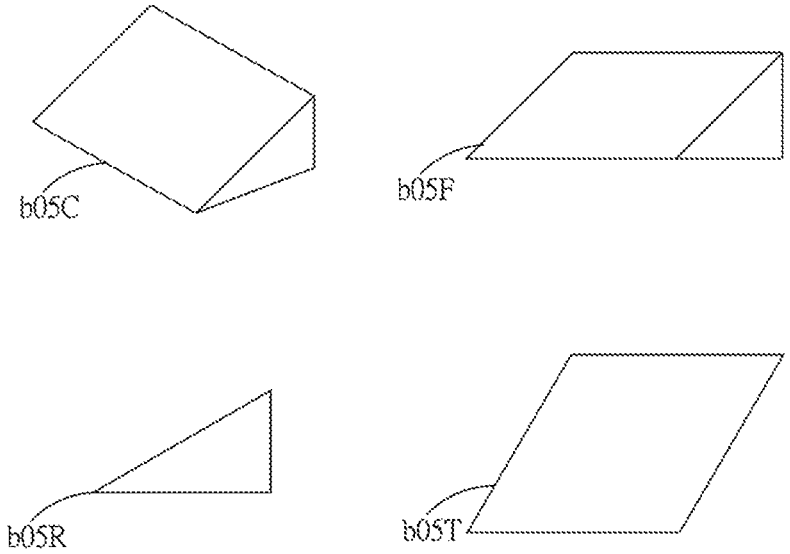
Figure 4F:
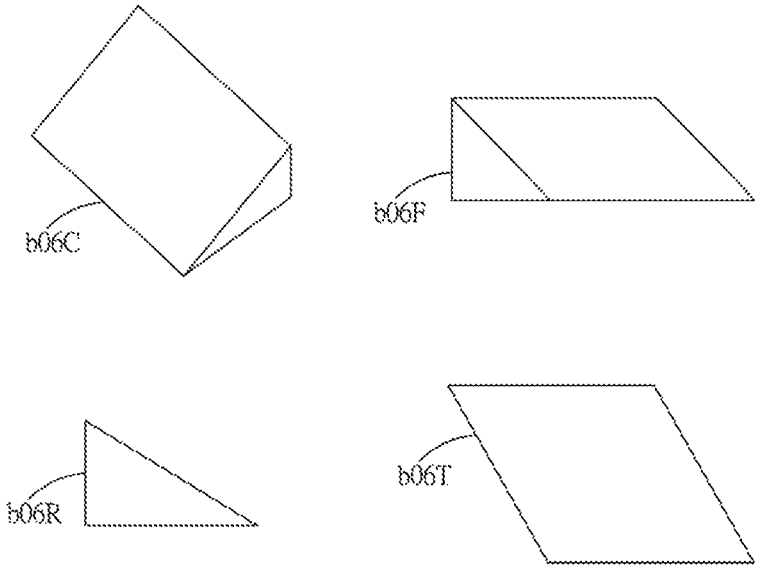
Figure 4G:
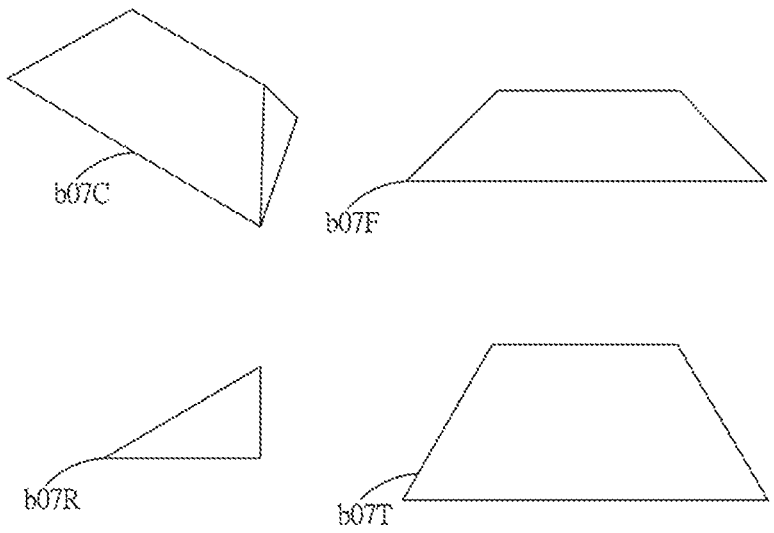
Figure 4H:
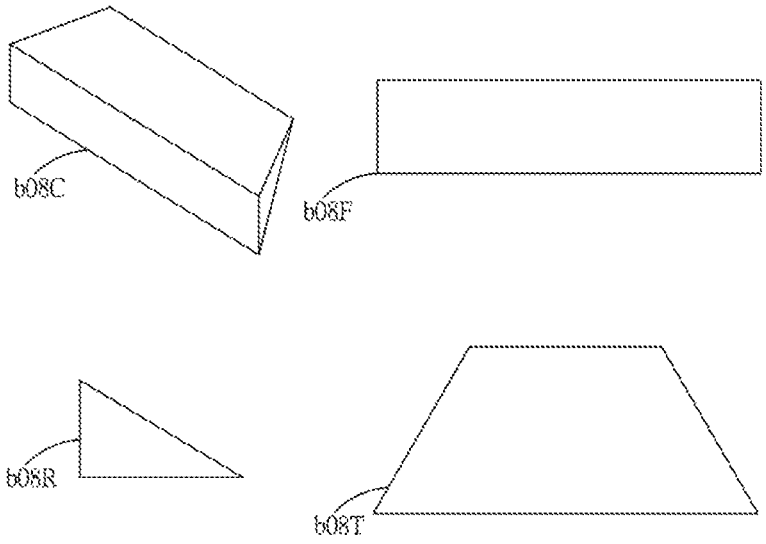
Figure 4I:
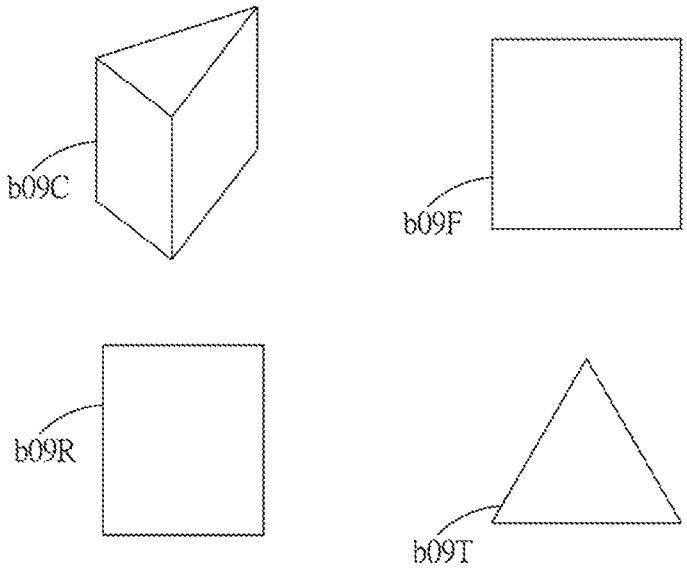
Figure 4J:
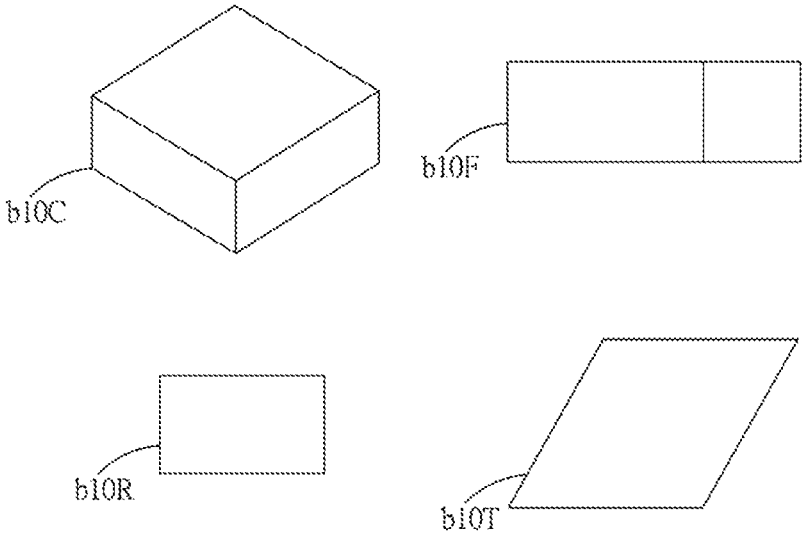
Figure 4K:
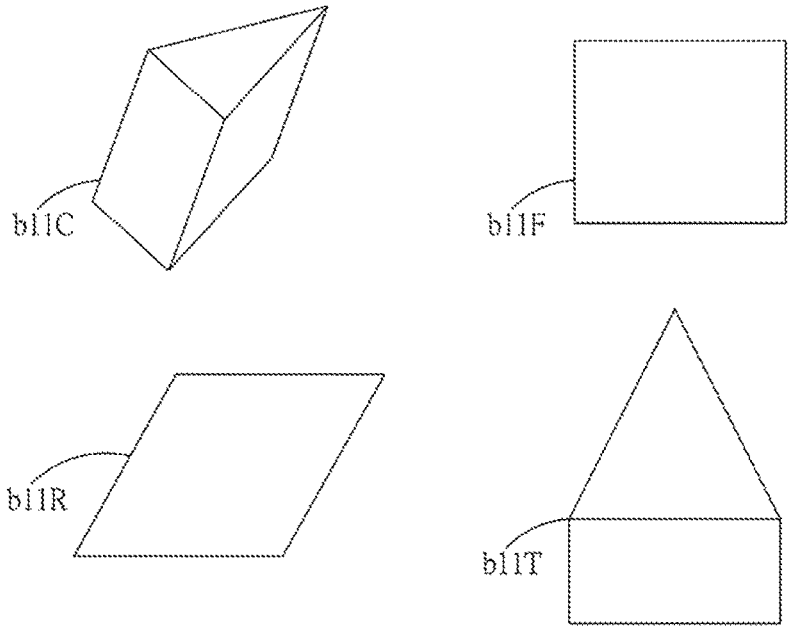
Figure 4L:
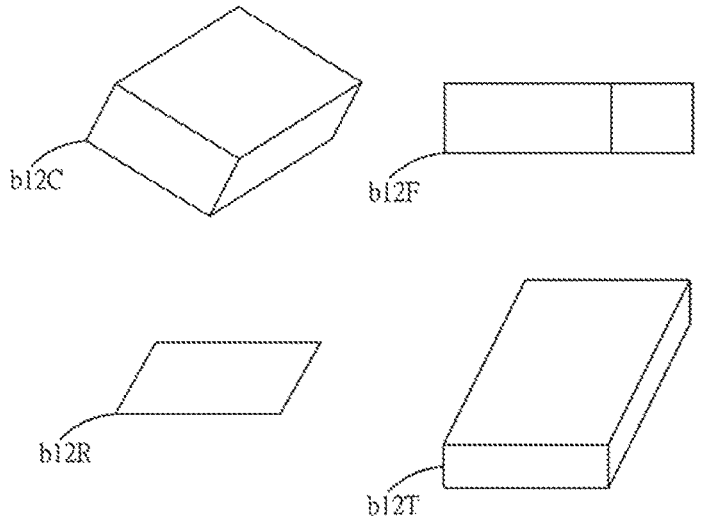
Figure 4M:
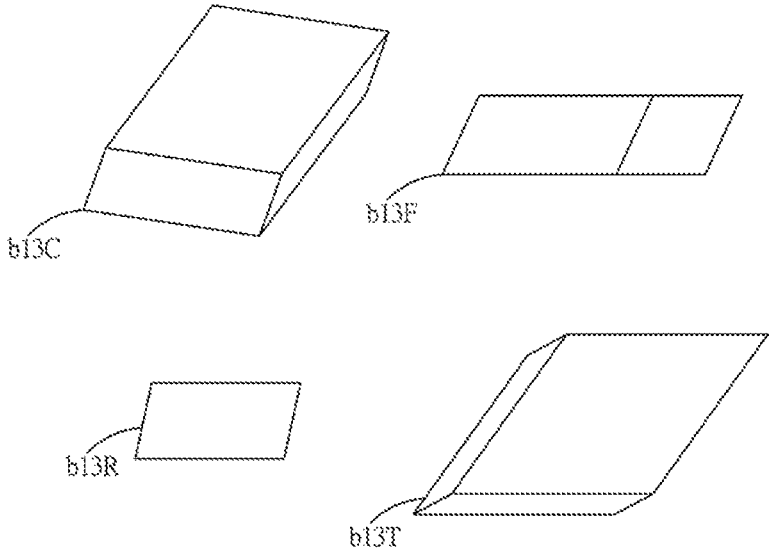
Figure 4N:
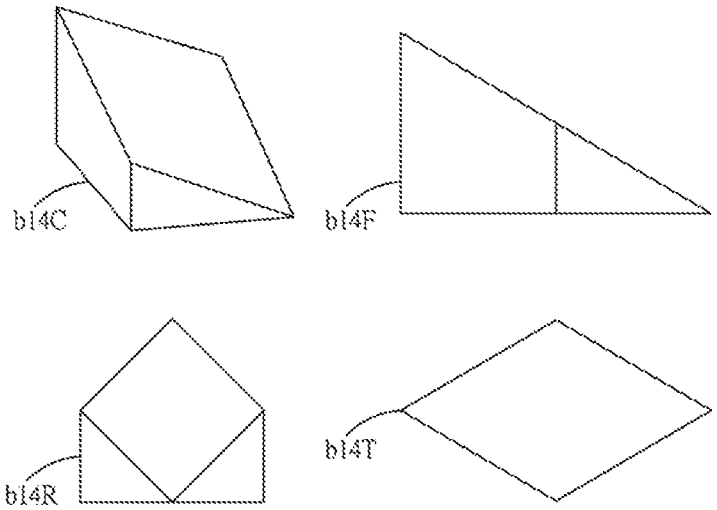
Figure 4O:
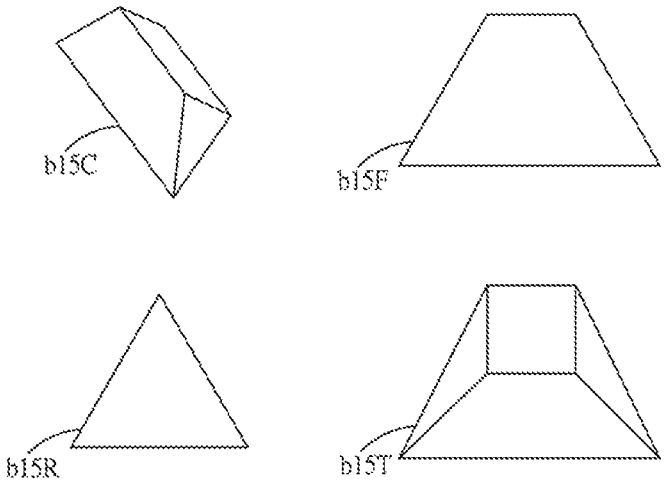
Figure 4P:
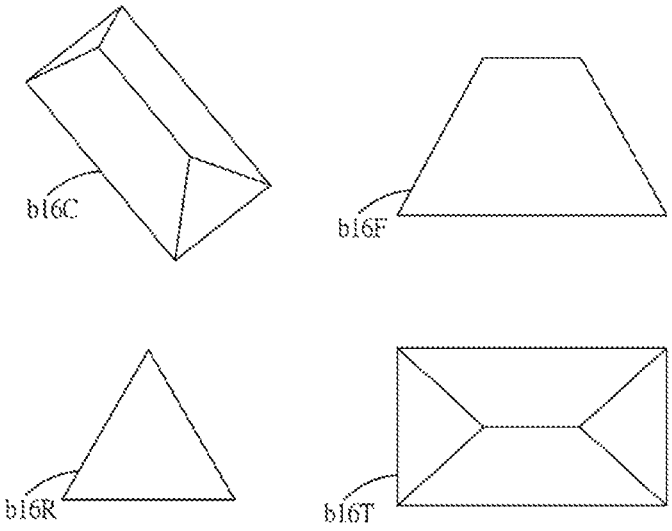
Figure 4Q:
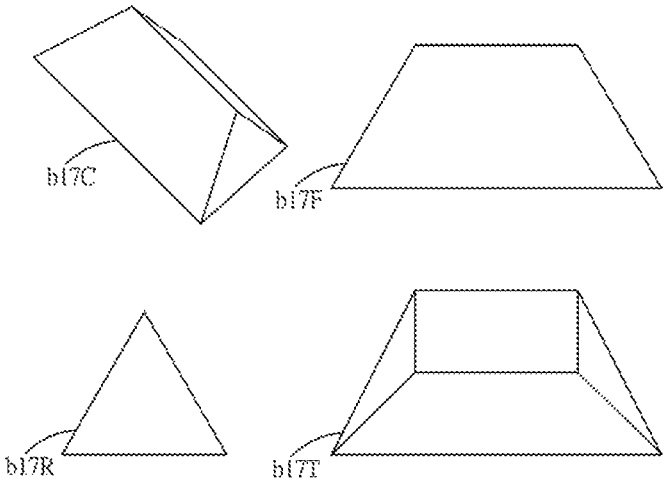
Figure 4R:
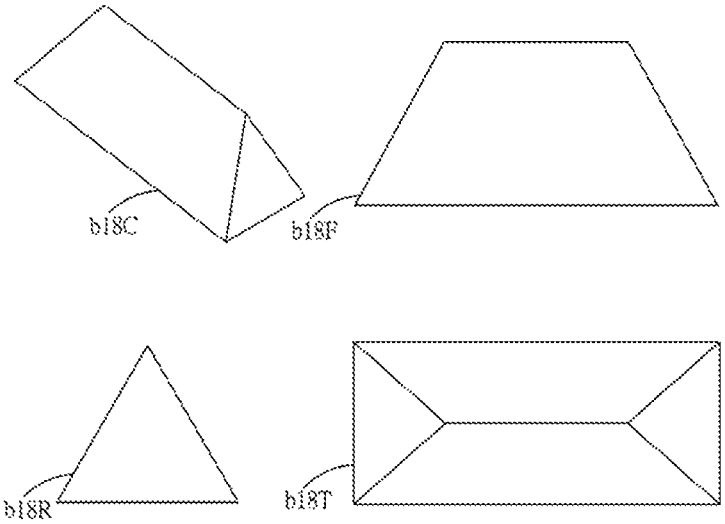

Please refer to FIGS. 4A to 4R, which are each the stereogram and three-view drawing of the first puzzles to the eighteenth puzzles of the present creation. As shown in the figures, in FIG. 4A, the first puzzle b01 is represented by stereograms FIG. b01C, front view FIG. b01F, right view FIG. b01R and upper view b01T. Similarly, the second puzzle b02 to the eighteenth puzzle b18 are represented in FIGS. 4B to 4R by the four views same as above.

TABLE 3

| Unit Component | Composition |
|---|---|
| The First Puzzle b01 | small unit component SU + small unit component SU |
| The Second Puzzle b02 | big unit component BU + big unit component BU |
| The Third Puzzle b03 | small unit component SU + big unit component BU |
| The Fourth Puzzle b04 | small unit component SU + big unit component BU |
| The Fifth Puzzle b05 | small unit component SU + big unit component BU |
| The Sixth Puzzle b06 | small unit component SU + big unit component BU |
| The Seventh Puzzle b07 | small unit component SU + big unit component BU + small unit component SU |
| The Eighth Puzzle b08 | big unit component BU + small unit component SU + big unit component BU |
| The Ninth Puzzle b09 | third puzzle b03 + third puzzle b03 |
| The Tenth Puzzle b10 | third puzzle b03 + third puzzle b03 |
| The Eleventh Puzzle b11 | fourth puzzle b04 + fourth puzzle b04 |
| The Twelfth Puzzle b12 | fifth puzzle b05 + sixth puzzle b06 |
| The Thirteenth Puzzle b13 | fourth puzzle b04 + fourth puzzle b04 |
| The Fourteenth Puzzle b14 | small unit component SU + third puzzle b03 + big unit component BU |
| The Fifteenth Puzzle b15 | small unit component SU + third puzzle b03 + small unit component SU |
| The Sixteenth Puzzle b16 | big unit component BU + third puzzle b03 + big unit component BU |
| The Seventeenth Puzzle b17 | small unit component SU+ third puzzle b03 + third puzzle b03 + small unit component SU |
| The Eighteenth Puzzle b18 | big unit component BU + third puzzle b03 + third puzzle b03 + big unit component BU |

Figure 5:
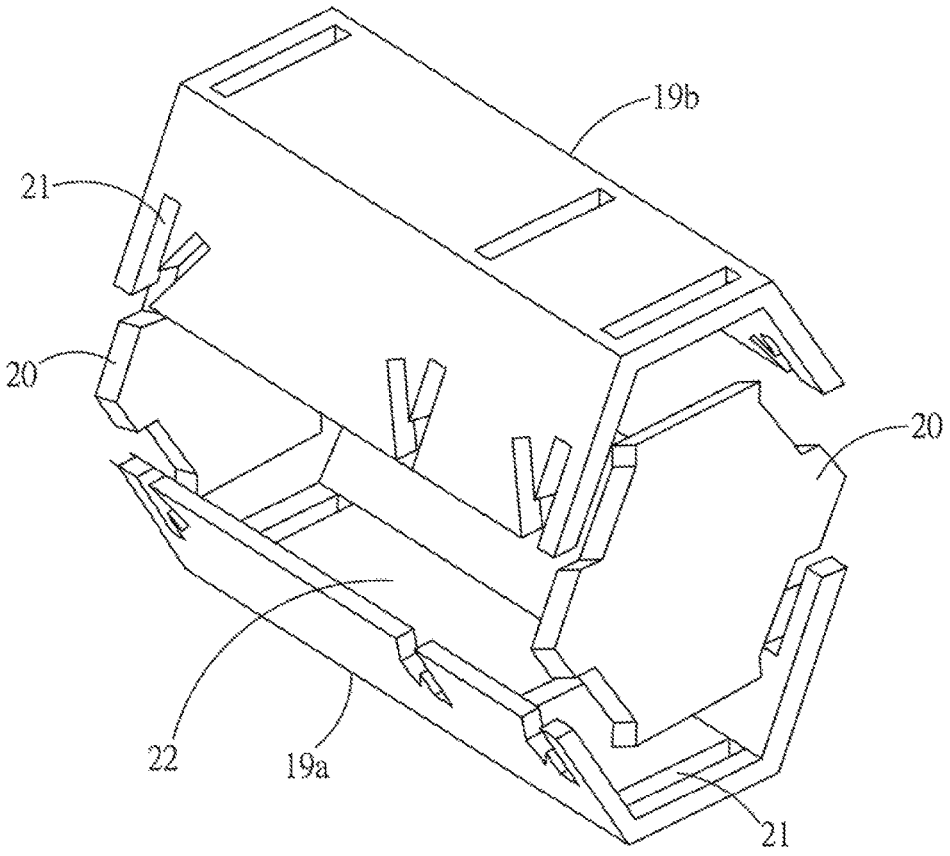
FIG. 5 is the schematic scheme of the puzzle frame of the present creation.

Please refer to FIG. 5, which is the schematic scheme of the puzzle frame of the present creation. As shown in the figure, the puzzle frame F includes a lower cover 19*a*, an upper cover 19*b* and two side plates 20. The lower cover 19*a* and the upper cover 19*b* both have a groove 21 corresponding thereto for insertion of the side plates 20 and forming a hexagonal prismatic accommodating space 22. The aforementioned 18 different puzzles (21 pieces) may exactly fill into the accommodating space 22 and accomplish a complete hexagonal prismatic structure. The lower cover 19*a* and the upper cover 19*b* may have the same and symmetrical structures, that is, an user may alternatively accomplish the packing puzzle by the support of the accommodating space 22 formed by the side plate 20 and lower cover 19*a* or the side plate 20 and the upper cover 19*b*, and cover the packing puzzle with another cover for easy carrying. Besides, the slope angle or interval distance of the groove of the puzzle frame F may be set to make the packing puzzle more changeable and improve diversity upon operation.

Figure 6:
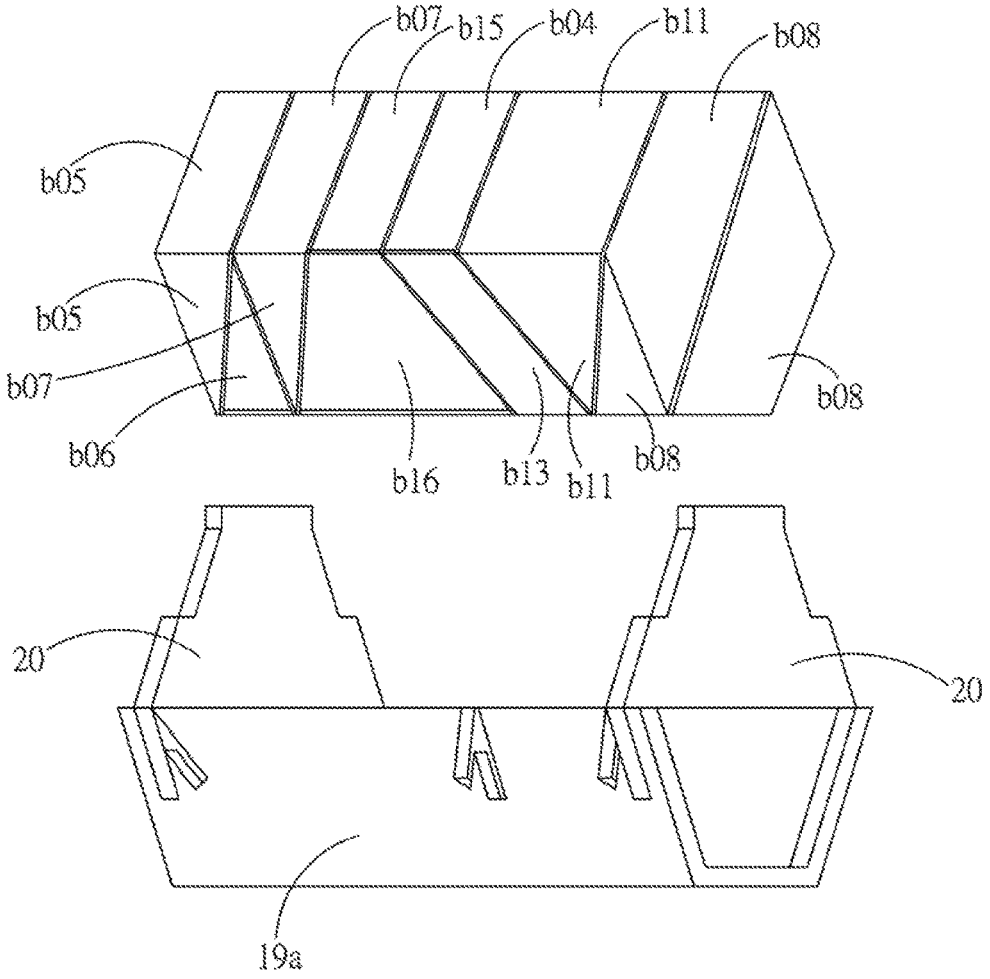
FIG. 6 is the schematic scheme of the first embodiment of the configuration of the puzzles of the present creation.

Please refer to FIG. 6, which is the schematic scheme of the first embodiment of the configuration of the puzzles of the present creation. As shown in the figure, the lower cover 19*a* and the side plates 20 of the puzzle frame F forms a hexagonal prismatic accommodating space and all of the puzzles are arranged as in the figure to exactly fill into the accommodating space. The arrangement of the present embodiment is only for demonstration. The hexagonal prism may also be accomplished by changing angles or arrangement. Hence, there may exist many kinds of solutions.

Figure 7:
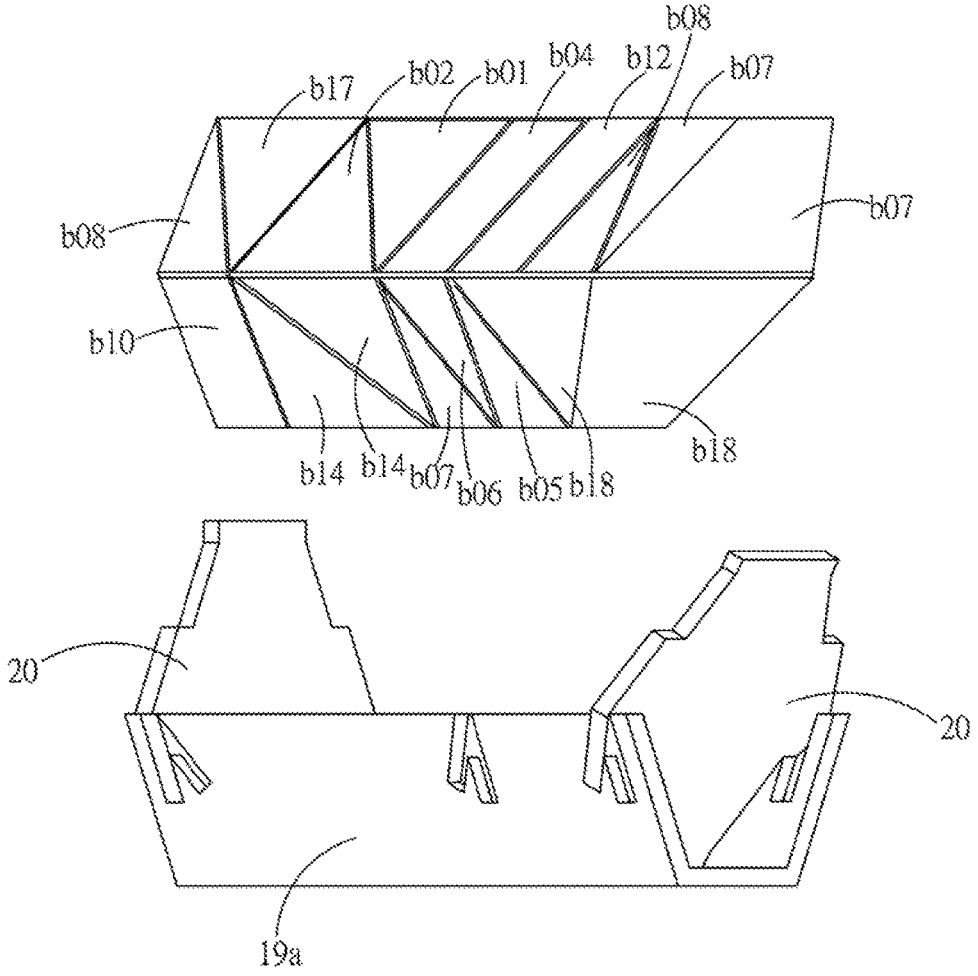
FIG. 7 is the schematic scheme of the second embodiment of the configuration of the puzzles of the present creation.
Figure 8:
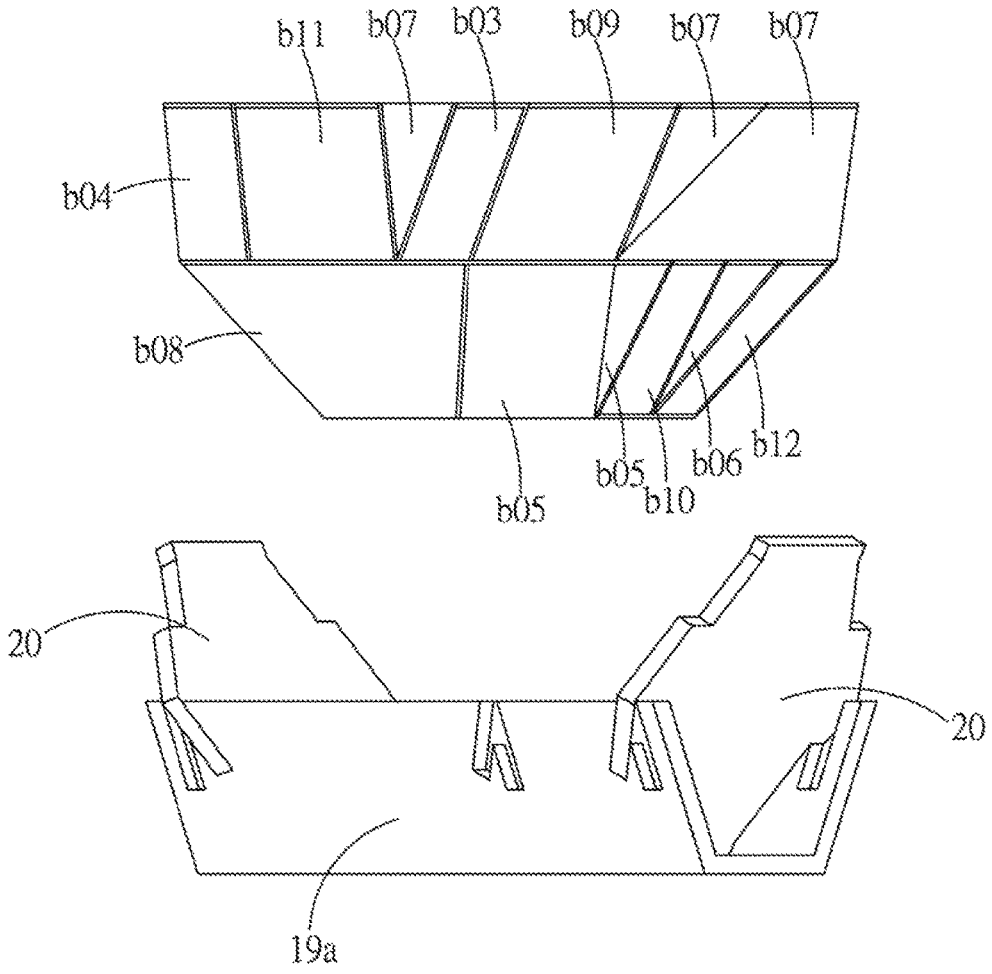
FIG. 8 is the schematic scheme of the third embodiment of the configuration of the puzzles of the present creation.

Please refer to FIGS. 7 and 8, which are the schematic scheme of the second and third embodiments of the configuration of the puzzles of the present creation respectively. As shown in FIG. 7, the groove 21 of the lower cover 19*a* is set at a slope angle so that the side plate 20 at the right side may provide a 30° angle between the side plate and the surface of the hexagonal prism when inserted, and another type of hexagonal prismatic accommodating space will be obtained. Since the shape of the complete structure is changed, the configuration of the puzzles may be different from the aforementioned embodiment. In the present embodiment, the puzzles may be configured as shown in FIG. 7, i.e. filling into a puzzle frame. Similarly, in FIG. 8, another groove 21 of the lower cover 19*a* may also be set at a slope angle so that the side plate 20 at the left side may provide a 30° between the side plate and the surface of the hexagonal prism when inserted, and yet another type of hexagonal prismatic accommodating space will be obtained. The puzzles may be filled into the puzzle frame as shown in the figures to accomplish the packing puzzle of the present embodiment.

Figure 9:
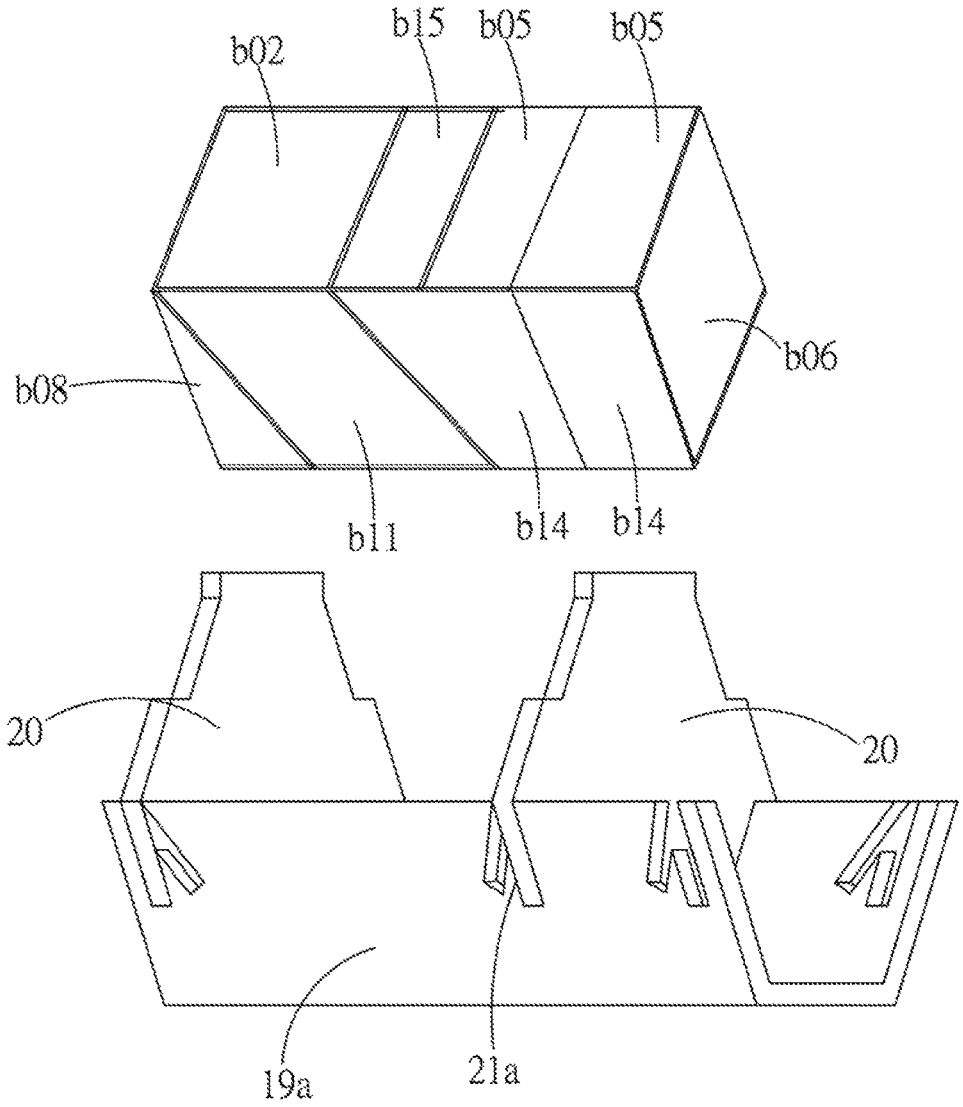
FIG. 9 is the schematic scheme of the fourth embodiment of the configuration of the puzzles of the present creation.

Please refer to FIG. 9, which is the schematic scheme of the fourth embodiment of the configuration of the puzzles of the present creation. As shown in the figure, the side plates 20 may be inserted as separation side plates into the separation groove 21*a* at the middle so that the length is shortened to ⅓ of original and the volume of the hexagonal prism is decreased to ⅔ original. Since the volume is changed, not all of the puzzles should be used to accomplish the packing puzzle but only 12 to 16 pieces. Similarly, the packing puzzle also has various solutions. The exemplary solution is shown in FIG. 9.

Figure 10:
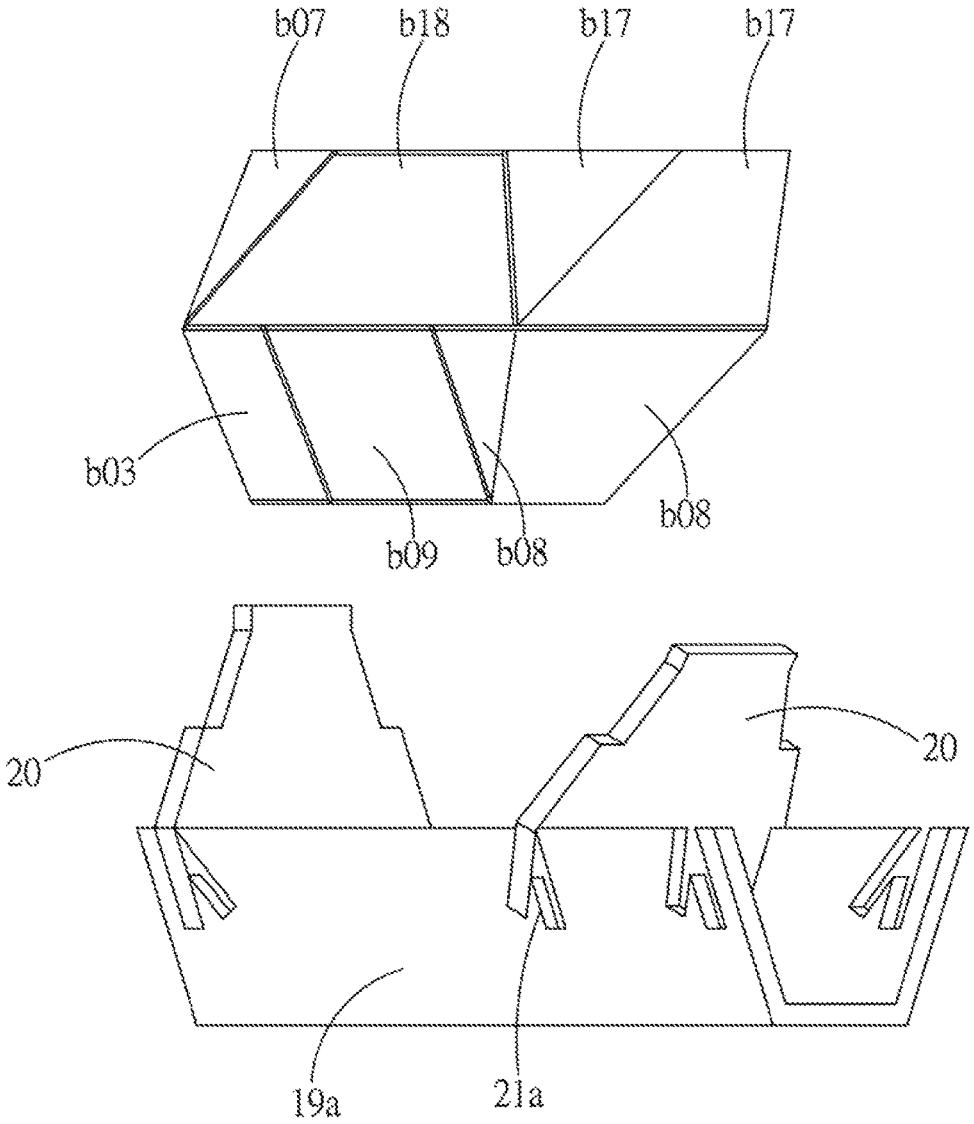
FIG. 10 is the schematic scheme of the fifth embodiment of the configuration of the puzzles of the present creation.
Figure 11:
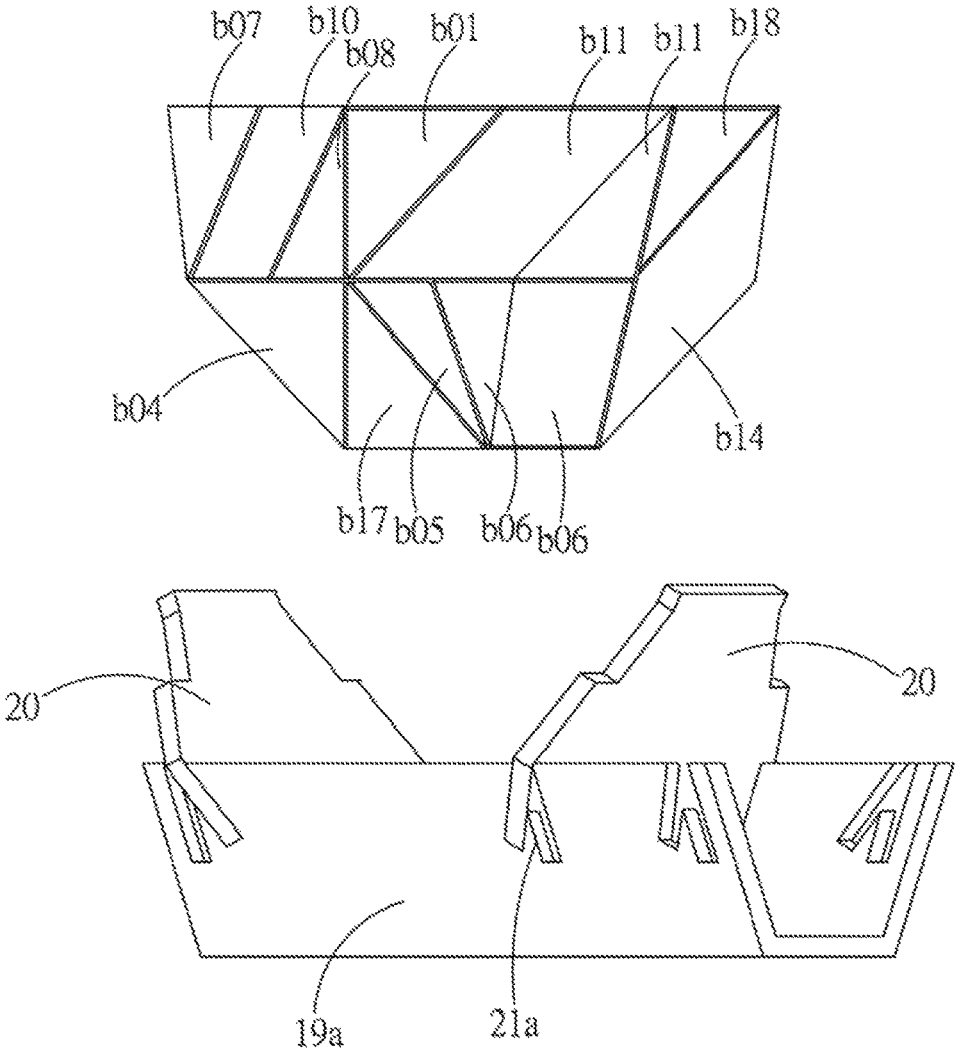
FIG. 11 is the schematic scheme of the sixth embodiment of the configuration of the puzzles of the present creation.

Please refer to FIGS. 10 and 11, which are the schematic scheme of the fifth and sixth embodiment of the configuration of the puzzles of the present creation respectively. As shown in the figures, when the side plates 20 are inserted into the separation groove 21*a*, the slope angle of the plate 20 may also be adjusted to obtain various complete structure of the packing puzzle. FIG. 10 is an aspect that the side plate 20 at the right side is set obliquely and the exemplary solution thereof. FIG. 11 is an aspect that the side plates 20 at two sides are all set obliquely and the exemplary solution thereof. Similarly, the solution of the packing puzzle of the present embodiment is not only limited to one.

The aforementioned descriptions are only for demonstration but not for limiting the scope of the present creation. A person skilled in the art is able to understand the core concept of the present invention after reading the content of above, and to modify the embodiment depending on requirements. In other words, the embodiment described above are not intended to limit the present invention. The scope protected by the present invention is defined by the appended claims.

What is claimed is:

1. A hexagonal prismatic packing puzzle, comprising:

a plurality of puzzles which are able to be pieced into a hexagonal prism, wherein:

each of the plurality of puzzles is composed of a plurality of unit components, the shapes of the plurality of the unit components are selected from a group consisting of a first unit component and a second unit component, the first unit component and the second unit component are formed by division along a section formed by three vertices of a triangular prism, a volume of the first unit component is larger than a volume of the second unit component, and a height of the triangular prism is equal to half of a side length of the triangular prism.

2. The hexagonal prismatic packing puzzle of claim 1, wherein the plurality of the puzzles comprises 18 different shapes, and the number of the plurality of puzzles is 21.

3. The hexagonal prismatic packing puzzle of claim 2, wherein the plurality of the puzzles comprising 18 different shapes comprises:

a first puzzle composed of two pieces of the second unit components;

a second puzzle composed of two pieces of the first unit components;

a third puzzle composed of one piece of the first unit component and one piece of the second unit component;

a fourth puzzle composed of one piece of the first unit component and one piece of the second unit component, wherein a configuration of the plurality of unit components of the fourth puzzle is different from a configuration of the third puzzle;

a fifth puzzle composed of one piece of the first unit component and one piece of the second unit component, wherein a configuration of the plurality of unit components of the fifth puzzle is different from the configurations of the plurality of unit components of the third puzzle and the fourth puzzle;

a sixth puzzle composed of one piece of the first unit component and one piece of the second unit component, wherein a configuration of the plurality of unit components of the sixth puzzle is different from the configurations of the plurality of unit components of the third puzzle, the fourth puzzle and the fifth puzzle;

a seventh puzzle composed of one piece of the first unit component and two pieces of the second unit components;

an eighth puzzle composed of two pieces of the first unit components and one piece of the second unit component;

a ninth puzzle composed of two pieces of the third puzzles;

a tenth puzzle composed of two pieces of the third puzzles, wherein a configuration of the two pieces of the third puzzles of the tenth puzzle is different from the configuration of the plurality of unit components of the ninth puzzle;

an eleventh puzzle composed of two pieces of the fourth puzzles;

a twelfth puzzle composed of one piece of the fifth puzzle and one piece of the sixth puzzle;

a thirteenth puzzle composed of two pieces of the fourth puzzles, wherein a configuration of the two fourth puzzle of the thirteenth puzzle is different from a the configuration of the plurality of unit components of the eleventh puzzle;

a fourteenth puzzle composed of one piece of the first unit component, one piece of the second unit component and one piece of the third puzzle;

a fifteenth puzzle composed of two pieces of the second unit component and one piece of the third puzzle;

a sixteenth puzzle composed of two pieces of the first unit components and one piece of the third puzzle;

a seventeenth puzzle composed on two pieces of the second unit components and two pieces of the third puzzles; and an eighteenth puzzle composed of two pieces of the first unit components and two pieces of the third puzzles.

4. The hexagonal prismatic packing puzzle of claim 3, wherein the numbers of the seventh puzzle, the eighth puzzle and the fourteenth puzzle are 2.

5. The hexagonal prismatic packing puzzle of claim 1, wherein the plurality of the puzzle comprises a plurality of arrangements for piecing together into a hexagonal prism.

6. The hexagonal prismatic packing puzzle of claim 1, further comprising a puzzle frame, wherein:

the puzzle frame comprises an upper cover, a lower cover and two side plates, the upper cover and the lower cover have a plurality of grooves individually, the two side plates insert into the plurality of grooves to form an accommodating space corresponding to the hexagonal prism.

7. The hexagonal prismatic packing puzzle of claim 6, wherein:

the plurality of the grooves are disposed with a slope angle; and a side slope angle of the hexagonal prismatic within the accommodating space is adjusted by the slope angle.

8. The hexagonal prismatic packing puzzle of claim 7, wherein the slope angle is 30°.

9. The hexagonal prismatic packing puzzle of claim 6, wherein:

an separation groove is disposed at the upper cover and the lower cover; and an separation plate is inserted into the separation groove to adjust a volume of the accommodating space.

10. The hexagonal prismatic packing puzzle of claim 9, wherein the volume of the accommodating space is equal to ⅔ of a volume of the hexagonal prism.

* * * * *